US011607574B1

(12) United States Patent
Kopke

(10) Patent No.: US 11,607,574 B1
(45) Date of Patent: Mar. 21, 2023

(54) CIRCULAR BLOCK SYSTEM FOR EXERCISING THE CORE OF A HUMAN

(71) Applicant: Wilhelm Kopke, Miami, FL (US)

(72) Inventor: Wilhelm Kopke, Miami, FL (US)

( * ) Notice: Subject to any disclaimer, the term of this patent is extended or adjusted under 35 U.S.C. 154(b) by 0 days.

(21) Appl. No.: 17/984,677

(22) Filed: Nov. 10, 2022

(51) Int. Cl.

| | |
|---|---|
| ***A63B 21/055*** | (2006.01) |
| ***A63B 21/00*** | (2006.01) |
| ***A63B 21/04*** | (2006.01) |
| *A63B 26/00* | (2006.01) |

(52) U.S. Cl.
CPC ..... *A63B 21/0557* (2013.01); *A63B 21/4027* (2015.10); *A63B 21/00047* (2013.01); *A63B 21/04* (2013.01); *A63B 21/0428* (2013.01); *A63B 26/003* (2013.01)

(58) Field of Classification Search
CPC ..... A63B 21/0557; A63B 21/4027; A63B 21/00047; A63B 21/00187; A63B 21/00185; A63B 21/002; A63B 21/0023; A63B 21/04; A63B 21/0421; A63B 21/0428; A63B 21/0442; A63B 21/055; A63B 21/0552; A63B 21/4033; A63B 21/4034; A63B 21/4035; A63B 26/003
See application file for complete search history.

(56) References Cited

U.S. PATENT DOCUMENTS

| | | | | |
|---|---|---|---|---|
| 11,389,691 | B2 * | 7/2022 | Reed, III | A63B 21/4033 |
| 2018/0360250 | A1 * | 12/2018 | Publicover | A63B 23/10 |
| 2022/0054882 | A1 * | 2/2022 | Wisniewski | A63B 71/0622 |
| 2022/0134169 | A1 * | 5/2022 | Bou-Rabee | A63B 21/154 482/93 |
| 2022/0273982 | A1 * | 9/2022 | Malagon | A63B 23/03525 |

* cited by examiner

*Primary Examiner* — Megan Anderson
(74) *Attorney, Agent, or Firm* — Ruben Alcoba, Esq.

(57) ABSTRACT

A circular block system that comprises of a circular block that has an inner peripheral side and an outer peripheral side, the peripheral sides have the same height. Opposing channels are defined on the outer peripheral sides. Crossing linear channels are defined on the bottom of the circular block. The crossing linear channels connect the opposing channels. A resistance band is passed through the crossing linear channels when using the circular block system to stretch or exercise. The top of the circular block is a non-slip surface.

11 Claims, 7 Drawing Sheets

CIRCULAR BLOCK SYSTEM FOR EXERCISING THE CORE OF A HUMAN

TECHNICAL FIELD

The present invention pertains to a circular block system for exercising the core of a human.

BACKGROUND

Presently, a rectangular block is used for engaging and strengthening the core of a human by gymnasts, dancers, and yoga practitioners. The strengthening of core occurs when the human is forced to balance on one foot on the rectangular block.

Gymnasts, dancers, and yoga practitioners use the rectangular block in conjunction with a resistance band that is manipulated either around the bottom of the rectangular block or around the arch of the foot.

Exercises are performed on the rectangular block by placing one foot on the rectangular block and elevating the other foot off the rectangular block. The resistance band is used to apply either an upward force from the rectangular block toward the human or an inward horizontal force toward the core of the human.

The resistance band serves to apply an additional force to the core of the human while stretching or conducting strengthening exercises on the rectangular block.

The rectangular blocks are used to strengthen the core, the posterior leg muscles, the erector muscles, and the muscles around the ankles of a human.

The rectangular blocks that are presently used to strengthen the core of the human lend themselves to tipping laterally. The tipping of the blocks often causes the human to injure him or herself when the blocks tip. The typical injury sustained by the human is a twisted ankle.

The present invention is designed to prevent injuries that occur when a human performs a one footed core strengthening exercise on a rectangular block.

SUMMARY

The present invention is directed to a circular block system for exercising the core of a human that prevents injuries.

The circular block system comprises of a circular block that has an inner peripheral side and an outer peripheral side, the peripheral sides have the same height. Opposing channels are defined on the outer peripheral sides. Crossing linear channels are defined on the bottom of the circular block. The crossing linear channels connect the opposing channels. A resistance band is passed through the crossing linear channels when using the circular block system to stretch or to conduct strengthening exercises. The top of the circular block is a non-slip surface.

The present invention is used by a human as follows: 1. The human places the bottom of the circular block on a flat surface; 2. The human places one foot on the top of the circular block so that the foot is centrally positioned on the circular block; and 3. The human raises one foot and performs stretching and balancing exercises on the top of the circular block.

The circular block can also be used by placing the resistance band under the channel that is on the bottom side of the circular block and by performing the same exercise, yet in this exercise the arms are used to place a force on the core of the human when the human pulls the resistance band upward.

The resistance band can also be used by the human by placing the resistance band around the arch of the foot of the human, the arch being on a vertical position in relation to the top of the circular block, and the human pulling the resistance band toward the core of the human.

An object of the present invention is to provide a circular block system that can be used by a human to strengthen his or her core when stretching or balancing.

Another object of the present invention is to provide a circular block system that will not tip over when the human is performing stretching or conducting balancing exercises.

Yet another object of the present invention is to provide a circular block system that will allow a human to stretch or strengthen his or her core without risking injury.

Yet still another object of the present invention is to provide a circular block system that will allow a human to use the protrusions of the device to massage the back and hips of the human.

DRAWINGS

These and other features, aspects, and advantages of the present invention will become better understood with regards to the following description, appended claims, and drawings where:

DESCRIPTION

Figure 1:
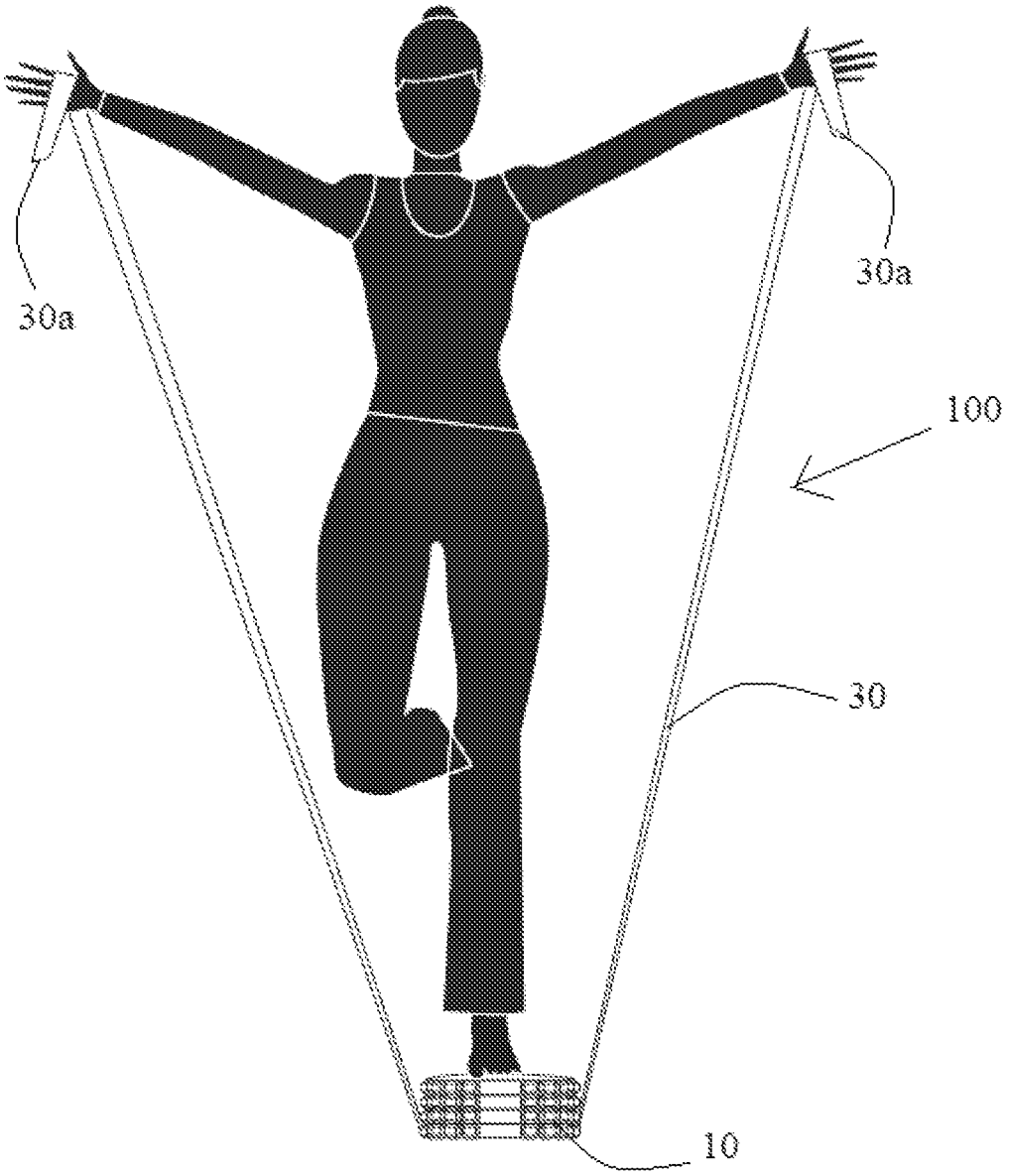
FIG. 1 is a front view of the present invention.
Figure 2:
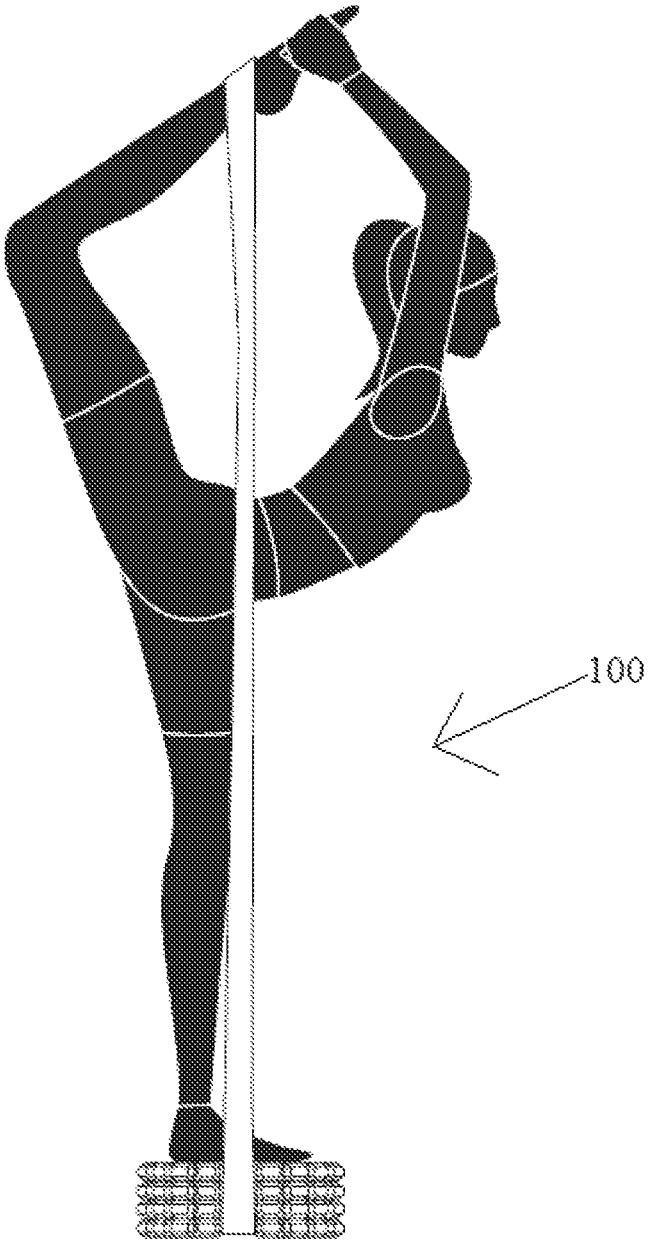
FIG. 2 is a side view of the present invention.
Figure 3:
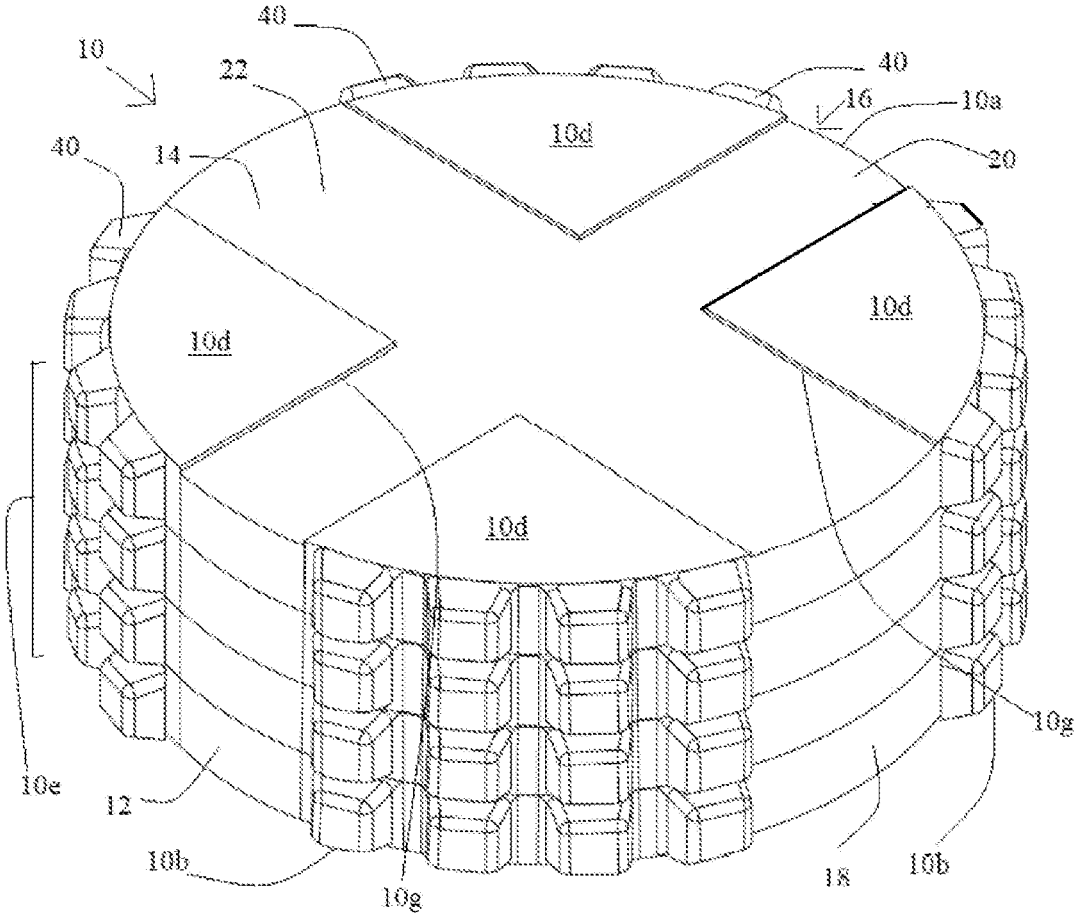
FIG. 3 is a bottom perspective view of the present invention.
Figure 4:
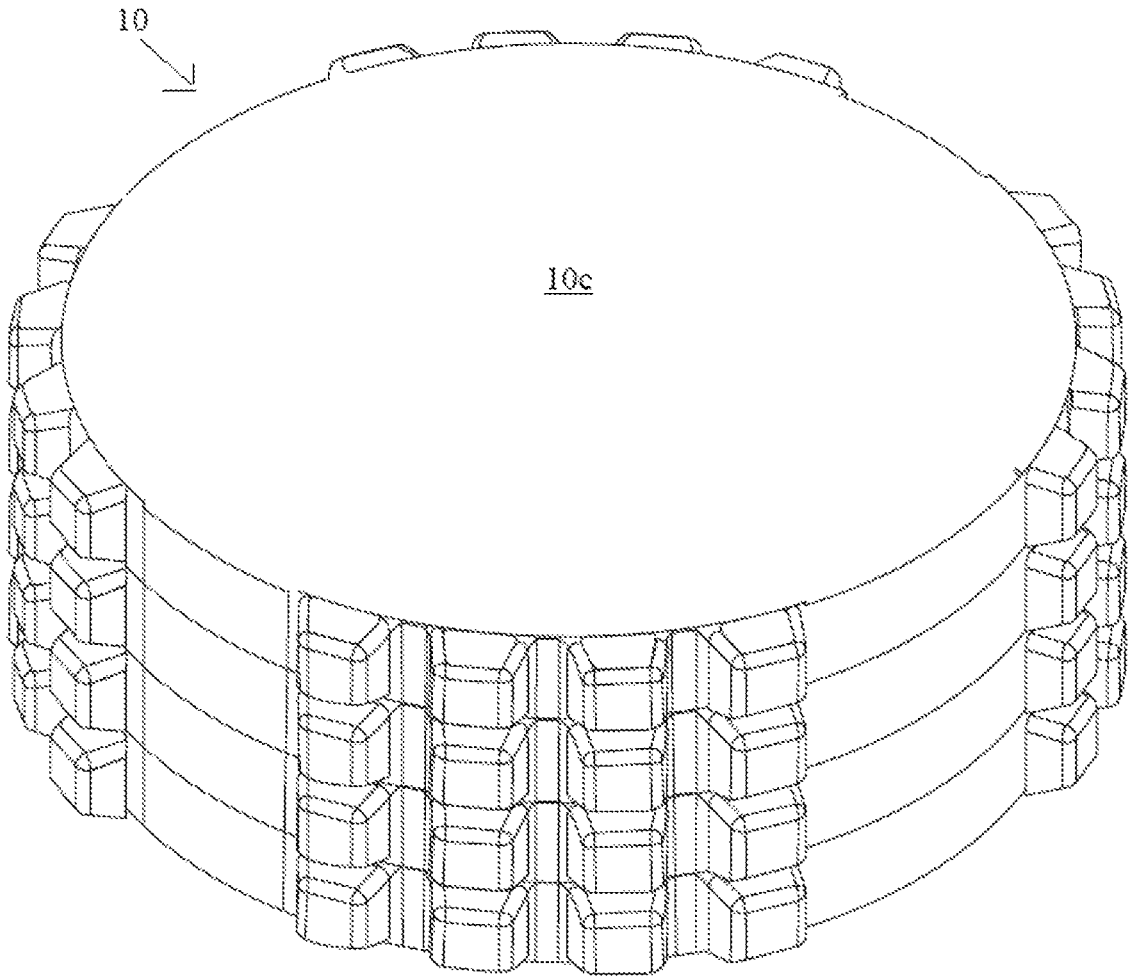
FIG. 4 is a top perspective view of the present invention.
Figure 5:
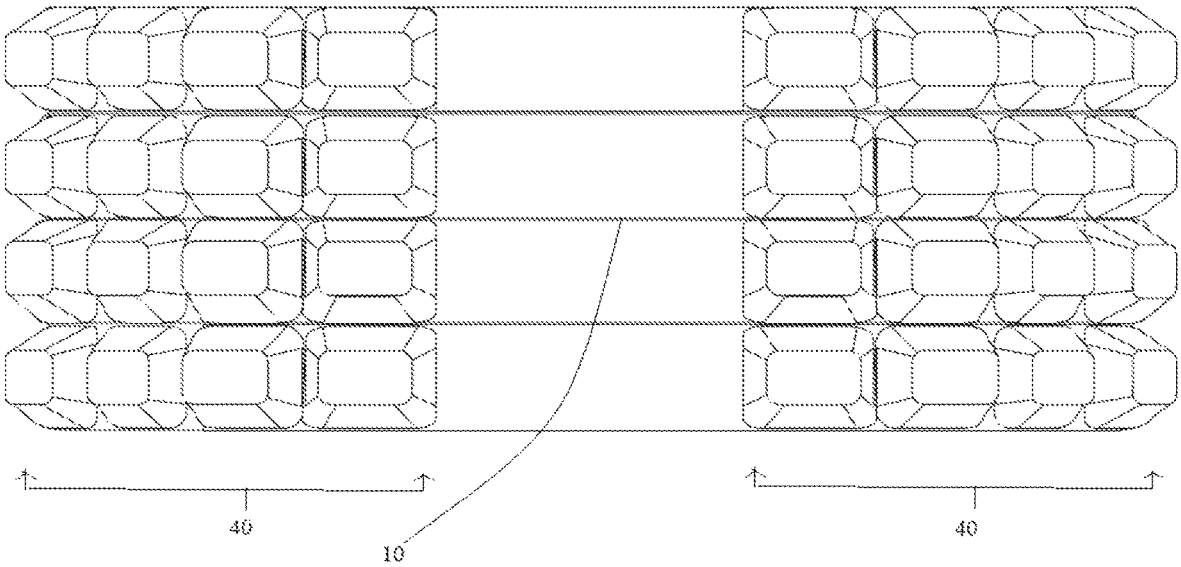
FIG. 5 is a side view of the present invention.
Figure 6:
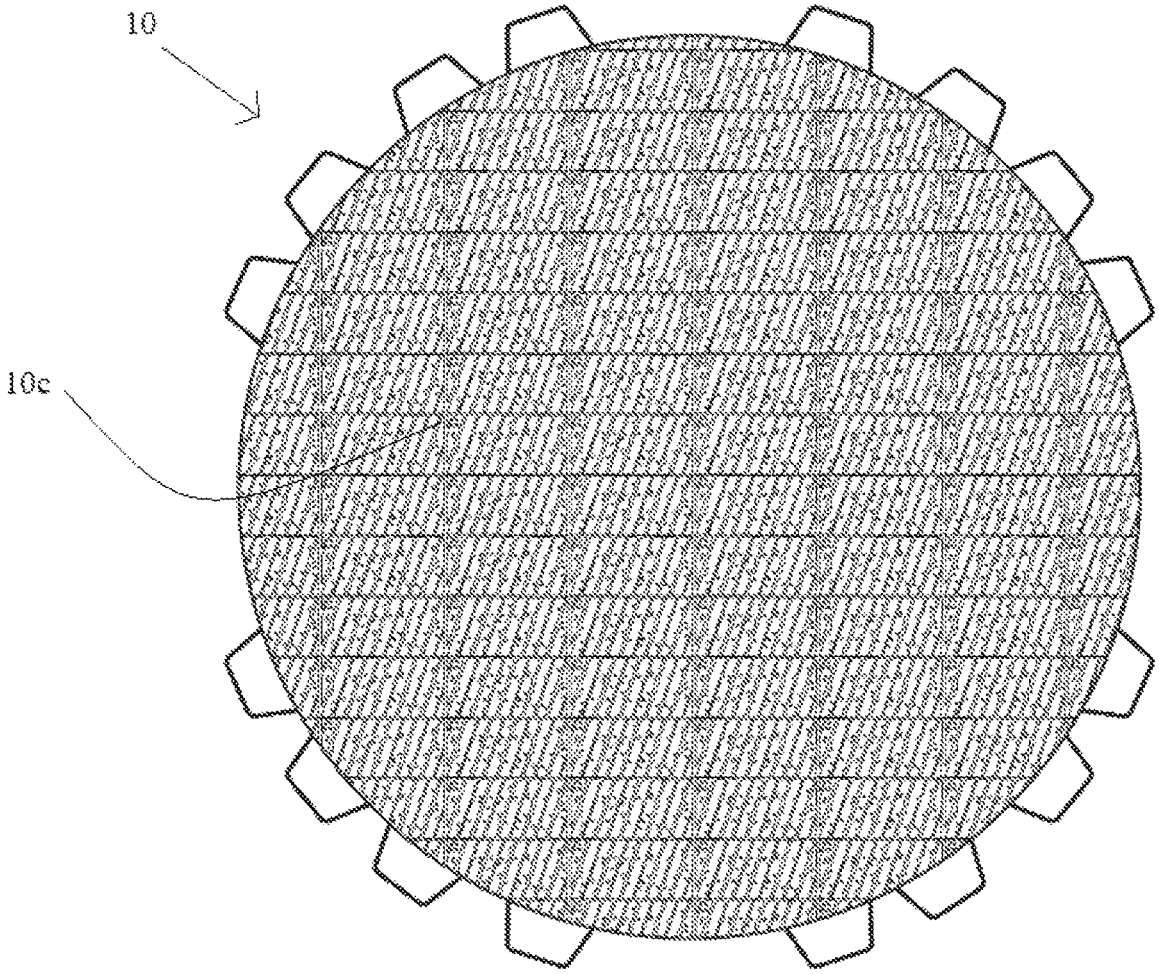
FIG. 6 is a top view of the present invention.
Figure 7:
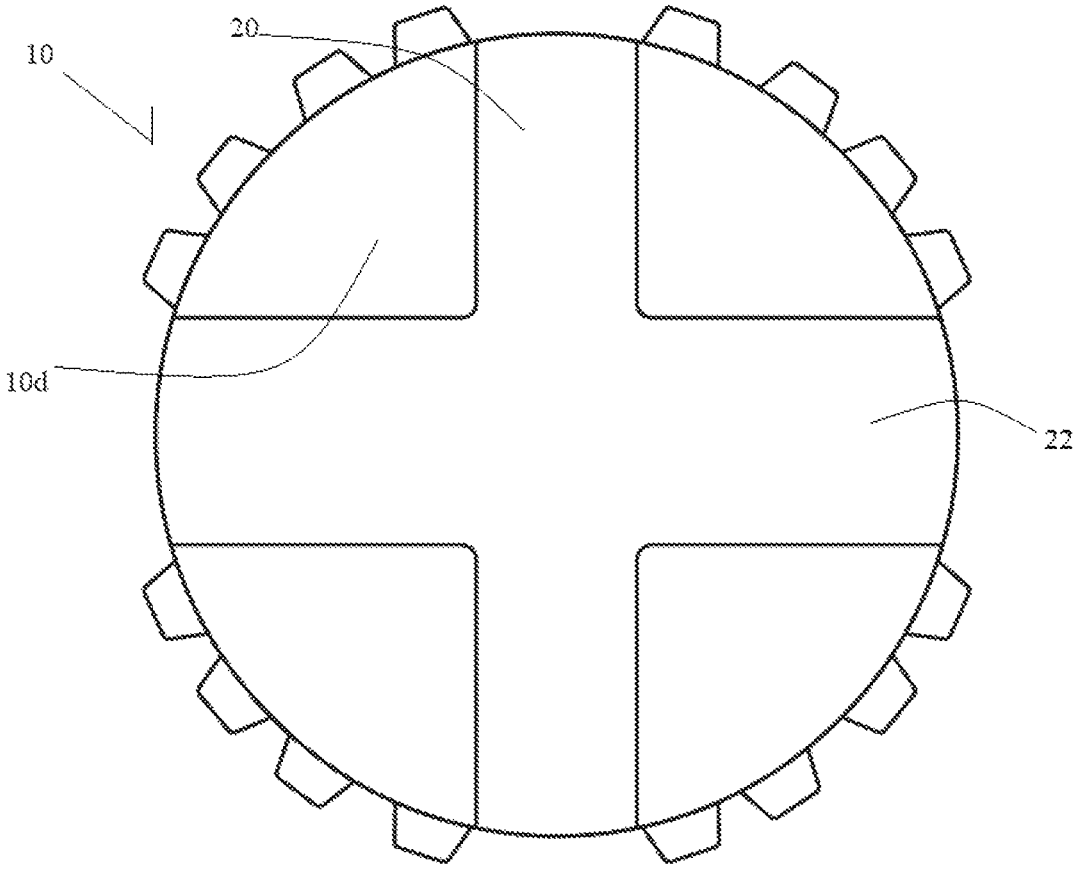
FIG. 7 is a bottom view of the present invention.

As seen in FIGS. 1-7, the present invention is a circular block system 100 for exercising the core of a human.

The circular block system comprises a circular block 10 that has an inner peripheral side 10*a*, an outer peripheral side 10*b*, a top side 10*c*, and a bottom side 10*d*, the inner peripheral side 10*a* and the outer peripheral side 10*b* have a same height 10*e*. The outer peripheral side 10*b* defines a first channel 12, a second, channel 14, a third, channel 16, and, a fourth channel 18, the first channel 12 aligns with third channel 16, the second channel 14 aligns with the fourth channel 18. The bottom side 10*d* of the circular block 10 defines a first linear channel 20 that connects the first channel 12 to the third channel 16 and a second linear channel 22 that connects the second channel 14 and to the fourth channel 18, the first linear channel 20 and the second linear channel 22 cross at a central location 10*f* of the bottom side 10*d* of the circular block 10. And, a resistance band 30 that has a pair of ends 30*a*, the resistance band 30 is configured to be placed within either the first linear channel 20 or the second linear channel 22 of the bottom side 10*d* and each of the pair of ends 30*a* of the resistance band 30 is configured to be pulled upward by the human when exercising.

In an embodiment of the present invention, the outer peripheral side 10*b* comprises of equally spaced projections 40 that extend outward from the inner peripheral side 10*a* to the outer peripheral side 10*b* of the circular block 10. The equally spaced projections 40 project outward for a distance that is at least one inch.

In another embodiment of the present invention, the first linear channel 20 and the second linear channel 22 have a height 10*g* of at least one-tenth of an inch.

In still another embodiment of the present invention, the height of the inner peripheral side 10*a* and the outer peripheral side 10*b* is at least four inches.

In yet still another embodiment of the present invention, the top side 10*c* is an anti-slip surface.

In a further embodiment of the present invention, the first linear channel 20 has a width that is at least two inches. The second linear channel 22 has a width that is at least three inches.

The plurality of protrusions of the present invention allows a human to roll the protrusions of the circular block on the body of the user, thereby providing a circular block system that is used by the human to massage him or herself.

An advantage of the present invention is that is provides a circular block system that is used by a human to strengthen his or her core when stretching or balancing.

Another advantage of the present invention is that if provides a circular block system that does not tip over when a human is balancing or stretching on the circular block of the circular block system.

Yet another advantage of the present invention is that it provides a circular block system that allows a human to stretch or strengthen his or her core without risking injury.

Yet still another advantage of the present invention is that it provides a circular block system that allows a human to use the protrusions of the device to massage the back and limbs of the human.

The embodiments of the circular block system described herein are exemplary and numerous modifications, combinations, variations, and rearrangements can be readily envisioned to achieve an equivalent result, all of which are intended to be embraced within the scope of the appended claims. Further, nothing in the above-provided discussions of the circular block system should be construed as limiting the invention to an embodiment or a combination of embodiments. The scope of the invention is defined by the description, drawings, and claims.

What is claimed is:

1. A circular block system for exercising the core of a human, the circular block system comprises:

a circular block that has an inner peripheral side, an outer peripheral side, a top side, and a bottom side, the inner peripheral side and the outer peripheral side have a same height, wherein:

the outer peripheral side defines a first channel, a second channel, a third channel, and a fourth channel, the first channel aligns with third channel, the second channel aligns with the fourth channel;

the bottom side of the circular block defines a first linear channel that connects the first channel to the third channel and a second linear channel that connects the second channel and to the fourth channel, the first linear channel and the second linear channel cross at a central location of the bottom side of the circular block; and a resistance band that has a pair of ends, the resistance band is configured to be placed within either the first linear channel or the second linear channel of the bottom side and each of the pair of ends of the resistance band is configured to be pulled upward by the human when exercising.

2. The circular block system for exercising the core of the human of claim 1, wherein the outer peripheral side comprises equally spaced projections that extend outward from the inner peripheral side to the outer peripheral side of the circular block.

3. The circular block system for exercising the core of the human of claim 2, wherein the equally spaced projections project outward for a distance that is at least one inch.

4. The circular block system for exercising the core of the human of claim 3, wherein the first linear channel and the second linear channel have a height of at least one-tenth of an inch.

5. The circular block system for exercising the core of the human of claim 4, wherein the height of the inner peripheral side and the outer peripheral side is at least four inches.

6. The circular block system for exercising the core of the human of claim 5, wherein the top side is an anti-slip surface.

7. The circular block system for exercising the core of the human of claim 6, wherein the first linear channel has a width that is at least two inches.

8. The circular block system for exercising the core of the human of claim 7, wherein the second linear channel has a width that is at least three inches.

9. The circular block system for exercising the core of the human of claim 1, wherein the first linear channel and the second linear channel have a height of at least one-tenth of an inch.

10. The circular block system for exercising the core of the human of claim 1, wherein the height of the inner peripheral side and the outer peripheral side is at least four inches.

11. The circular block system for exercising the core of the human of claim 1, wherein the top side is an anti-slip surface.

* * * * *